US006547005B2

(12) United States Patent
Haheim

(10) Patent No.: US 6,547,005 B2
(45) Date of Patent: Apr. 15, 2003

(54) SYSTEM AND A METHOD OF EXTRACTING OIL

(75) Inventor: Svein Audun Haheim, Oslow (NO)

(73) Assignee: ABB Research Ltd., Zurich (CH)

( * ) Notice: Subject to any disclaimer, the term of this patent is extended or adjusted under 35 U.S.C. 154(b) by 0 days.

(21) Appl. No.: 09/790,495

(22) Filed: Feb. 23, 2001

(65) Prior Publication Data

US 2001/0017207 A1 Aug. 30, 2001

(30) Foreign Application Priority Data

Feb. 23, 2000 (NO) ..... 000900

(51) Int. Cl.[7] ..... E21B 43/38

(52) U.S. Cl. ..... 166/265; 166/357; 210/800; 210/521

(58) Field of Search ..... 166/265, 105.5, 166/242.3, 357; 210/519, 521, 532.1, 540, 800, 170, 747, 744

(56) References Cited

U.S. PATENT DOCUMENTS 5,141,054 A * 8/1992 Alameddine et al. .... 166/252.1
5,197,543 A * 3/1993 Coulter ..... 166/281
5,309,998 A 5/1994 Rivas et al.
5,443,120 A * 8/1995 Howell ..... 166/265
5,826,655 A * 10/1998 Snow et al. ..... 166/272.3

FOREIGN PATENT DOCUMENTS

| | | |
|---|---|---|
| GB | 2 292 574 | 2/1996 |
| GB | 2 326 895 | 1/1999 |
| WO | WO 98/41304 | 9/1998 |
| WO | WO 99/25480 | 5/1999 |

* cited by examiner

*Primary Examiner*—David Bagnell
*Assistant Examiner*—T. Shane Bomar
(74) *Attorney, Agent, or Firm*—Oblon, Spivak, McClelland, Maier & Neustadt, P.C.

(57) ABSTRACT

An oil well system for extracting oil extracted from a reservoir via a well, includes a separator device adapted to separate oil and water from a mixture extracted from a reservoir. The separator device has a non-vertical first flow path for the mixture and being arranged along a non-vertical portion of the well, a second flow path, separate from the first flow path, for receiving water or a water enriched phase that has been separated from the mixture by the separator device, and a plurality of drain openings along a section of the first flow path. The first and second flow paths are arranged such that water or the water enriched phase in the first flow path can flow by gravity to the second flow path via the drain openings. An opening area of the drain openings, per unit area of the first flow path, decreases in a flow direction of the mixture along the first flow path.

22 Claims, 5 Drawing Sheets

SYSTEM AND A METHOD OF EXTRACTING OIL

FIELD OF THE INVENTION

The present invention relates to a system for extracting oil, comprising a well for extracting oil from an oil reservoir, a separator device for separating oil and water out of an extracted mixture that comprises water and oil, said separator device comprising a deviated first flow path for said mixture and being arranged along a deviated portion of the well, and a second flow path for receiving water or a water enriched phase that has been separated from the oil-water mixture in the separator device. The separator device comprises a plurality of draining openings along a section of the deviated first flow path, via which the water or water enriched phase flows under the action of gravitational forces from the first flow path to the second flow path.

The invention also comprises a method of extracting oil from an oil reservoir, comprising the steps of extracting a liquid mixture comprising oil and water from the reservoir via a first flow path in a well, and separating, under gravity in a deviated section of the well, the liquid into separate streams one of which mainly comprises water or a water enriched phase, the water or water enriched phase being passed from the first flow path to a separate second flow path via a plurality of draining openings along a section of the deviated first flow path.

The system and method particularly relates to down-hole separation of an extracted oil-water mixture in any oil field, on land as well as off-shore.

The term oil-water mixture should be regarded in a broad sense, and it should be understood that such a mixture is also likely to contain gaseous components such as natural gas as well as solids such as sand particles. The water or water enriched phase separated from the mixture may also contain such further components.

BACKGROUND OF THE INVENTION

The majority of oil reservoirs world-wide start to produce water as they mature. The water/oil ratio, i.e. the water cut, varies with geographical location and the nature and age of the reservoir. As the number of mature fields increase, the industry is facing a need for techniques that ensure economical and efficient production of oil with increasing water cut.

The lifecycle cost for an oilfield can be significantly reduced if the available topside process plant is dedicated to oil production all through the life of the field. If the water cut in the incoming stream is reduced, this may create capacity that will allow tie-in of additional wells, or increased production from existing wells.

The fact that reduced water cut enables increased production of oil is the essence of the drive towards separation of oil and water prior to the entering of the wellstream on the topside facilities.

Down hole separation will in many cases enhance the oil production because, for example, the tubing head pressure will increase significantly as the water is removed down hole, and the increased tubing head pressure will be used to increase the flow of oil from the well. Alternatively the pressure of a first stage gravity separator which might be included in the system, for instance arranged on a topside installation, will be increased, and thus the gas flashed off in the first stage separator will need less compression before being injected or exported.

Gravity separation is in many ways an advantageous solution to separation in the well since this is an extension of the natural separation in the wellbore.

PRIOR ART

A method and apparatus of separating the components of the fluid produced by an oil well which comprises down hole separation under gravity in a deviated non-vertical section of a wellbore is disclosed in GB 2 326 895, to Schlumberger Limited. According to this document, at least two separate flow paths having openings to the flow of the fluid at an upper end of or within a non-vertical section of the well are provided. The gravity is allowed to separate the fluid flow into a hydrocarbon enriched part and a water enriched part. The hydrocarbon-enriched part is flowing through the upper of the vertically separated openings, and the water-enriched part is flowing through the lower of the separated openings.

However, according to the above document, all the water or water enriched part is separated from the oil enriched part at one single location. For practical flow rates, a large amount of the hydrocarbon-enriched part, mainly oil, will follow the water-enriched part, and hence there will be an undesired reduction of the separation efficiency. When, for example the water enriched part is re-injected into an oil reservoir from which the fluid is extracted, this means that also oil that has already been extracted is re-injected into the reservoir, which is an undesirable effect for obvious efficiency reasons.

OBJECT OF THE INVENTION

It is an object of the invention to provide a system for extracting oil which comprises a gravity separator device for down hole separation of water and oil that shall promote an efficient separation of water from oil by means of gravitational separation at an early stage after that an oil-water mixture has been extracted from an oil reservoir, and that is robust and represents an advantageous alternative to prior art separators from an economical point of view.

SUMMARY OF THE INVENTION

The object of the invention is achieved by means of the initially defined system, which is characterised in that the draining opening area per area unit decreases in the flow direction of the oil-water mixture along said section of the deviated first flow path.

Thereby there will be a pressure compensation between the draining openings, which will promote a large separation capacity of the separator. It should be understood that the draining openings are distributed in the flow direction of the oil-water mixture and at different altitude levels. In this context, openings are referred to as slots in a wall arranged between the first and second flow path, but may have other implementations such as holes or perforations. Preferably such a wall is the wall of a tube or tubing that encloses and defines the first flow path.

The draining opening area per area unit decreases in the flow direction of the oil-water mixture along said section of the deviated first flow path. If, for example, the draining openings comprise slots or holes in a wall section between the first and second flow path, the distance between such openings may be increased and/or the individual size of such openings be decreased in the flow direction of the oil-water mixture in order to accomplish this feature. Thereby, less oil will follow the water or water enriched phase through the draining openings to the second flow path than would otherwise be the case, as consideration is taken to the changing separation conditions that exist along the draining section due to changing pressure conditions and concentration changes in the oil-water mixture that passes through that section.

According to a developed embodiment, the draining openings are distributed along a distance of at least 100 times the length of the diameter of the first flow path. In general terms, the basic idea is to provide a draining section long enough to ensure that the water in the oil-water mixture gets time to separate due to the gravitational forces, and to form a water or water enriched layer in a lower part of the first flow path. Then, by means of the draining openings, the water is continuously drained off from the first flow path along the draining section. When optimising the configuration and distribution of the draining openings consideration is taken to the flow rate of the oil-water mixture in the first flow path.

According to one embodiment the system of the invention is characterised in that, at least in the section along which the draining openings are located, the cross section of the first flow path is locally expanded such that, under the prevailing pressure conditions in the well, a locally reduced flow rate of the oil-water mixture is obtained along said section. Flow rate is referred to as flow velocity measured in m/s and should be low enough to permit a gravitational separation of water along the draining section. A preferred flow rate, in order to achieve a successful separation and draining, is below 3 m/s, preferably below 1 m/s.

Preferably the first flow path is defined by a first tube, and the system comprises a second tube which encloses the first tube and defines an annular path between itself and the first tube, wherein the annular path comprises the second flow path. Preferably, a conventional production casing that surrounds the production tube or tubing forms the second tube. Such a solution is advantageous both from an economical and technical point of view. The system may also comprise further tubing, at least partly arranged in the annular path between the first and second tube, for further transportation of the water or water enriched part separated from the oil-water mixture, thereby defining a continuation of the second flow path.

According to a further embodiment, the second flow path comprises a path for re-injection of water to the oil reservoir. The water re-injected is the water that has been separated from the oil-water mixture in accordance with the teachings of the invention. Thereby advantages already discussed in the introductory part of this application are obtained. Depending on the prevailing conditions in the reservoir, the path for re-injection is arranged so as to transport the water back into the reservoir via the same well as the oil-water mixture has been extracted through or, alternatively, via a different well branch or a different well so as to transport the water back to the reservoir at a given distance from the well via which the oil-water mixture has been extracted. The distance should be long enough to ensure that the re-injected water is not immediately re-circulated into the well. As a further alternative, the path for re-injection may be substituted by a path for discharge of the water into the sea.

The invention also relates to a method of extracting oil. The inventive method shall promote an efficient separation of water from oil by means of gravitational separation at an early stage after that an oil-water mixture has been extracted from an oil reservoir. It is also an object of the invention that the method shall result in a minimum of oil being separated and drained off together with the water from the oil-water mixture. The method shall permit an oil-water mixture flow rate that is acceptable from a practical and economical point of view without having an unacceptable amount of oil drained off together with the water.

This objective is achieved by means of the initially defined method, which is characterised in that it comprises the step of providing a decreasing draining opening area per area unit in the flow direction of the oil-water mixture along said section of the deviated first flow path.

The water or water enriched phase shall be drained off from the oil-water mixture at different altitude levels along the deviated first flow path in order to make it possible to continuously drain off water that, due to for instance the mixture configuration, settles with different rates in the gravity separator formed by the deviated first flow path. Preferably, the water is drained off via openings that are distributed in the flow direction of the oil-water mixture in the first flow path.

Further advantages and features of the present invention will be described in the following detailed description and in the appended claims.

BRIEF DESCRIPTION OF THE DRAWINGS

The invention will now be described more in detail with reference to the drawings, in which.

DETAILED DESCRIPTION OF PREFERRED EMBODIMENTS

Figure 1:
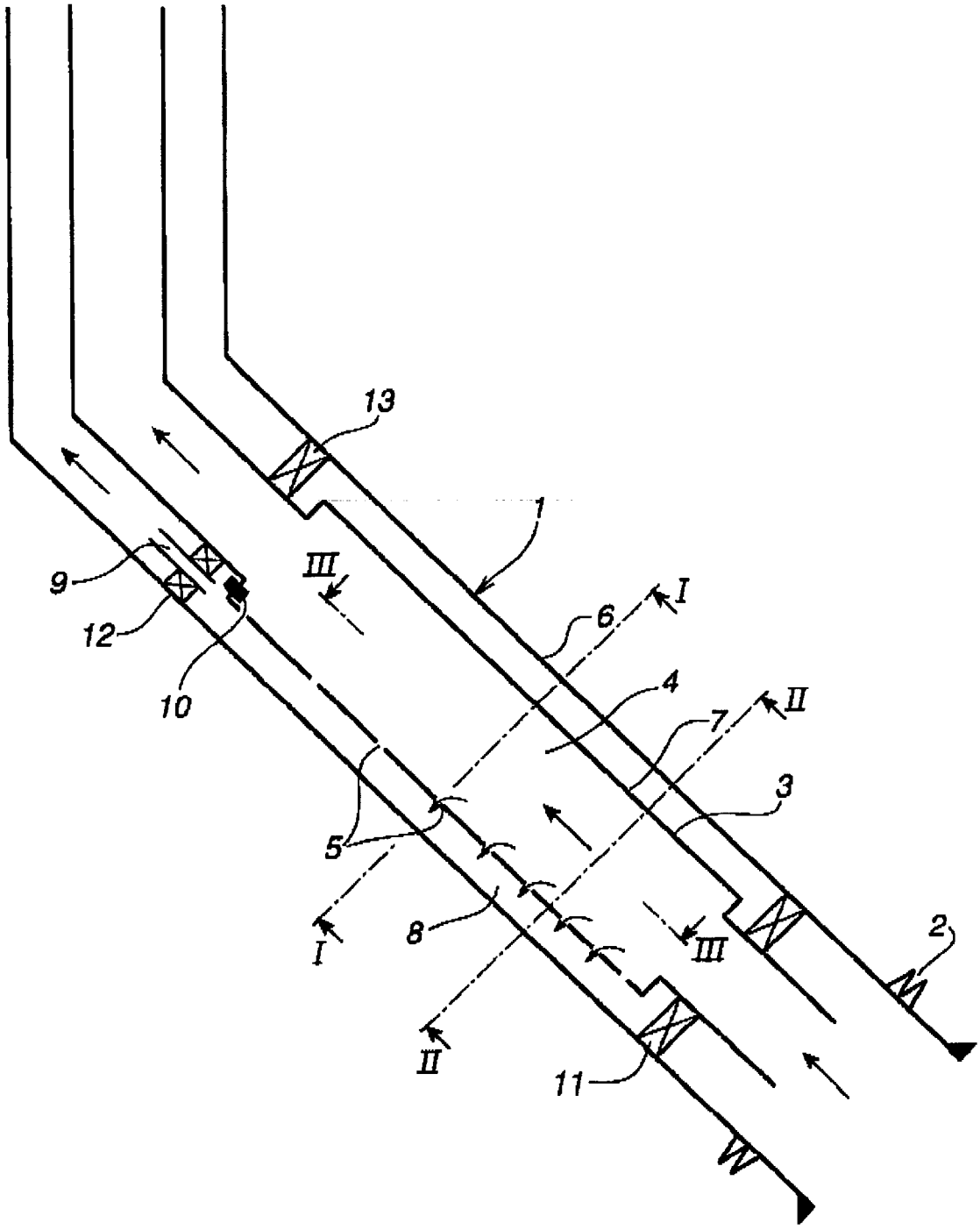
FIG. 1 is a schematic cross sectional side view of an inventive separator device according to a first embodiment.

FIG. 1 shows a first embodiment of a separator device 1 according to the invention. The separator device 1 forms part of a system for extracting oil via a well from an oil reservoir. The separator device is preferably arranged as close to the reservoir as possible. In FIG. 1 there are indicated production perforations 2 via which the oil-water mixture is extracted and led into a first tube 3. Such perforations may be of any conventional type and their configuration is not crucial to the invention.

The first tube or tubing 3 defines a first flow path 4 via which the oil-water mixture is extracted from the reservoir and the oil or oil enriched phase is further transported to in this case an off-shore platform.

Along a predetermined deviated section of the tube or tubing 3 there are draining openings 5 arranged in a bottom region, that is a lower region, of the cross section of the tube or tubing 3. Outside the tube 3 there is arranged a second tube or tubing 6 which encloses the first tube 3, thereby defining an annular space 7 between the first and second tubes 3, 6. The second tube 6 defines a production casing which encloses the first tube 3 all the way from below the separator to the wellhead in the case of an off-shore application.

The task of the draining openings 5 is to permit water or a water enriched phase that, due to the action of gravitational forces, is settled at a lower region of the cross section of the first flow path 4 to be drained off to a second flow path 8. Via the second flow path 8 the water or water enriched phase is mainly conducted back into the reservoir, preferably at a predetermined distance from the well in question, or to disposal. Here the second flow path 8 comprises at least a part of the annular space 7. Hence, the annular space 7 forms part of a path for further transportation of the water or water enriched phase that has been separated from the oil-water mixture via the draining openings 5 in the first tube 3. At a bottom region of the annular space 7 there is arranged a packer 11 between the first tube 3 and the second tube 6 for sealing the bottom of the space 7. Accordingly, water drained off from the first flow path 4 via the draining openings 5 is gathered in a bottom region of the space 7, from which it is further transported. Here, there is also provided upper packers 12, 13 that seal the space 7 a predetermined distance above the region in which the water is gathered. A water outlet 9 is however arranged in the packer 12.

Figure 2:
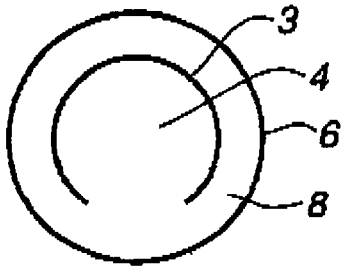
FIG. 2 is a cross sectional view according to I—I in FIG. 1.
Figure 3:
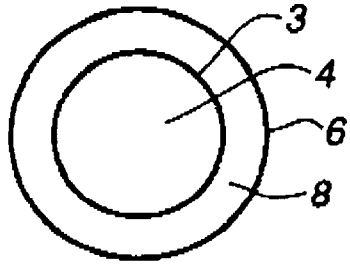
FIG. 3 is a cross sectional view according to II—II in FIG. 1.
Figure 4:
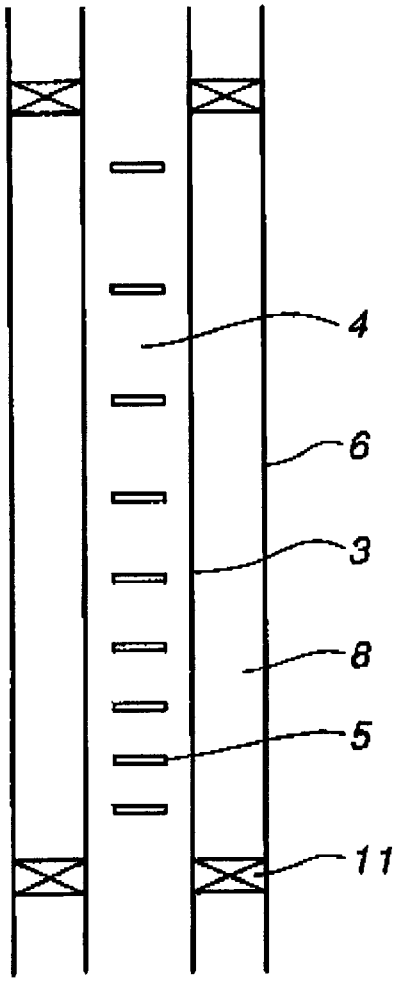
FIG. 4 is a cross sectional view according to III—III in FIG. 1.

The draining openings 5 are distributed along a predetermined length of the deviated section of the well, that is the first tube 3. As can be seen in FIG. 4 the total opening density, that is the area of the openings in relation to the wall area of the first tube 3 in the draining section or zone decreases in the intended flow direction of the oil-water mixture in the first flow path. This is a result of the distance between adjacent openings 5 being systematically increased in the flow direction and the area of the individual openings 5 being decreased in the flow direction. Here, the openings 5 comprise elongated slots extending in a direction crosswise to the length direction of the tube 3. The openings are provided at a lower sector of the cross section of the circular tube 3, preferably a circle sector of 60–90 degrees, as shown in FIG. 2. FIG. 3 is a cross sectional view according to II—II in FIG. 1.

In order to design the pressure compensating draining openings so as to achieve an optimised separation capacity the turbulent inclined oil/water flow has to be taken into consideration. The pressure compensation of the slots or holes 5 is required to achieve a uniform drainage as the pressure difference between the oil enriched phase flowing in the first tube 3 and the water or water enriched phase flowing in the second tube 6 will increase along the draining section in the flow direction of the oil-water mixture. The flow in the first tube 3 comprises three layers, a bottom layer of a continuous water phase, a mixed layer with relatively large oil droplets generally in circular motion, and a top layer of a continuos oil phase. The drainage or separation flow rate of the water phase layer should be sufficiently low at any point along the bottom of the inclined draining section. The oil droplet generation mechanism may be described as follows: The water will, because of gravity, want to drain downward at the oil/water interface. The water may thus bridge the oil flow at the interface, and create an oil droplet or a bubble in the water. When this bridging occurs, the water film surrounding the droplet is broken and the oil in the droplet, having a velocity roughly the same as the oil flow, will be released into the water phase normal to the interface. The droplet is then slowed down due to drag in the slower flowing water phase, and eventually rises towards the interface where it coalesces with the oil flow. In addition, oil droplets may coalesce in the water phase layer. The water drainage velocity along the draining section must be limited so the rise velocity of the oil droplets always is higher than said drainage velocity. A cross sectional view of an elongated slot 5 in the lower wall section of the drainage section in FIG. 4 is shown in FIG. 5.

Figure 5:
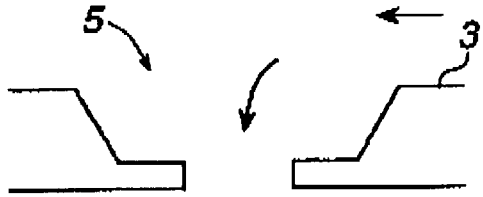
FIG. 5 is a cross sectional view of a draining opening in FIG. 4.

As shown in FIG. 5, the slot 5 comprises a first funnel-shaped part towards the first flow path 4 and a second part towards the second flow path 8. The cross sectional area of the first part of the slot 5 is gradually decreasing in the drainage flow direction to the second part of the slot. The second part of the, or more precisely each, slot has a predefined cross sectional area. Thus, the function of the first part of the slot 5 is to achieve a sufficient low drainage flow rate, and the function of the second part of the slot is to achieve a sufficient pressure drop for pressure compensation.

FIG. 5 shows only a schematic example of how a draining opening 5 can be designed regarding the profile and dimensions to create a low water drainage flow rate and a pressure compensation, and there may be many modifications of the design to accomplish said features apparent to those skilled in the art. Examples are cup shaped openings with the cup towards the first flow path, and v-shaped openings. Also it is possible to have a first part of the opening 5 comprising a larger part of the inner diameter of the draining section than the second part of the opening, or a multitude of first parts for one common second part of the draining opening. Regardless of design, the first part of the opening towards the first flow path 4 must be designed based on a criterion limiting the oil droplet rise velocity, and the second part of the opening towards the second flow path 8 designed to achieve a sufficient pressure drop.

Figure 6:
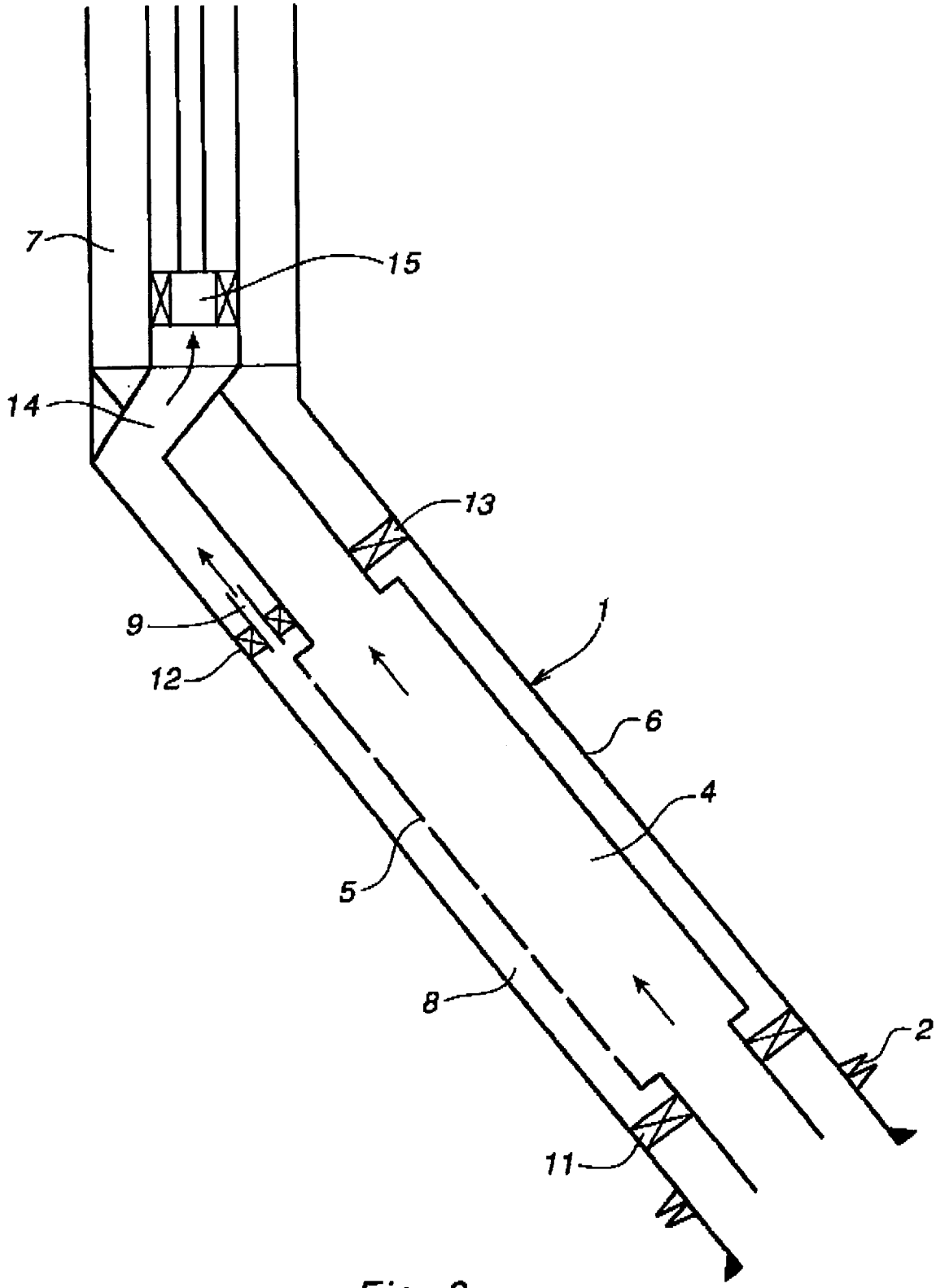
FIG. 6 is a schematic cross sectional side view of a second embodiment of the inventive separator device.

FIG. 6 shows a second embodiment of the separator device according to the invention, particularly suitable for applications in which there is a low reservoir pressure or a low productivity condition. Here, the system comprises a means 14 for redirecting the second flow path 8 from the annular space 7 to the first tube 3 and for redirecting the first flow path 4 from the first tube 3 to the annular space 7. Accordingly the routes of the first and second flow paths 4,8 are switched. The redirecting means 14 comprise a so-called cross-flow packer and is arranged downstream the separator device 1 as seen in the flow direction of the extracted oil and the water or water enriched phase separated therefrom in the separator device 1. By redirecting the second flow path in such a way that it obtains a circular cross section instead of an annular cross section a pump 15 for pumping the water or water enriched phase can more easily be arranged inside the second flow path 8. Here, the system comprises such a pump 15 arranged in the first tube 3 in the region where the second flow path 8 has been redirected into the first tube 3, that is downstream the redirecting means 14. Hence, the process of separating water from an extracted oil-water mixture by means of the inventive separator device and re-injecting the water into the reservoir takes into consideration the need of aid for producing a required water flow also when there is a low reservoir pressure.

Figure 7:
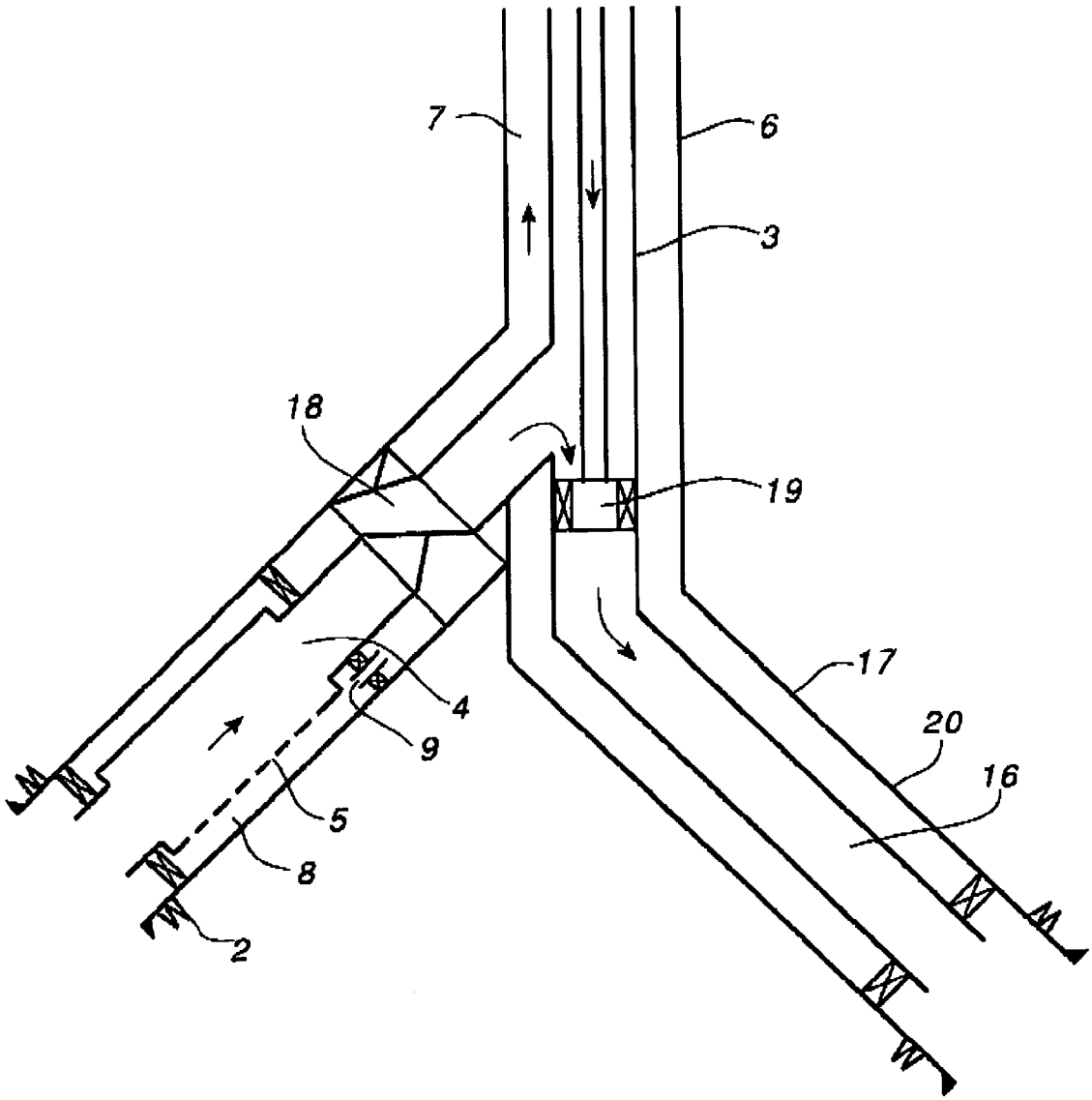
FIG. 7 is a schematic cross sectional side view of a third embodiment of the inventive separator device.

FIG. 7 shows a third embodiment of the inventive system in which the second flow path 8 comprises a path 16 for re-injection of water to the oil reservoir, wherein the re-injection path 16 re-injects the water at a predetermined distance from the well-bore via which the oil-water mixture has been extracted. For example, the water is re-injected via any other well in a field of wells. A separate tubing 17 that defines a branching of the first and second tubes 3,6 encloses and defines the re-injection path 16. A cross-flow means 18 is arranged downstream the separator device 1 for the same purpose as the redirecting means 14 described above. Further downstream, in the re-injection path 16 there is arranged a pump 19 for pumping the water or water enriched phase back into the reservoir via the re-injection path 16. Also the tubing 17 that defines the re-injection path 16 is enclosed by a production casing, here a tube 20 that forms a branching of the second tube or tubing 6. From an upper part of the system, additional water is conducted to the pump 19. Optionally, the additional water is conducted inside a pump hang-off tube.

Figure 8:
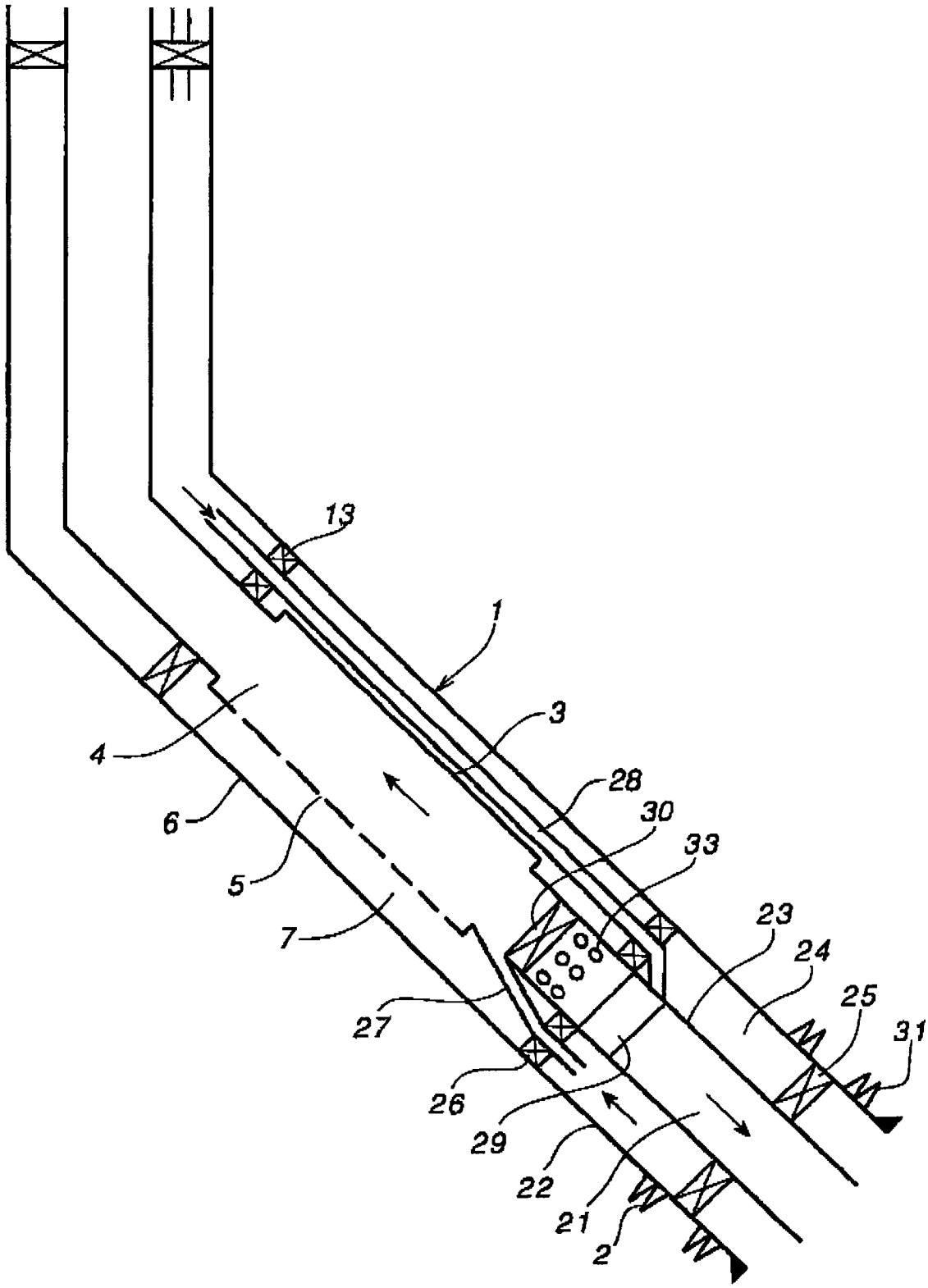
FIG. 8 is a schematic cross sectional side view of a fourth embodiment of the separator device according to the invention.

FIG. 8 shows an embodiment of the inventive separator device, in which the second flow path 8 comprises a path 21 for re-injecting the water or water enriched phase into the oil reservoir via the same well bore as the one from which the oil-water mixture has been extracted. The separator device is provided with draining openings as in the foregoing embodiments. However, the oil, and water, is extracted from the reservoir via production perforations 2 arranged in an outer tube 22 that surrounds an inner tube 23 and defines an annular path 24 into which the oil-water mixture is directed. The outer and inner tubes 22, 23 are extensions of the second tube 6 and first tube 3 respectively. Re-injection perforations 31 for re-injecting the water are arranged at the end of the production casing or outer tube 22.

The annular path 24 is sealed by means of packers 25, 26. However there is arranged a pipe 27 via which the extracted oil-water mixture is conducted through one of the packers 26 to the first flow path 4 inside the first tube 3. Water is then drained off from the mixture in accordance with the invention.

A pump 29 is arranged inside the inner tube 23 for the purpose of pumping water that has been separated from the oil in the separator back into the reservoir via a channel defined by the inner tube 23. Accordingly, the pump is in communication with the second flow path 8. Here, the second flow path 8 comprises a part of the annular space 7 between the first and second tubes 3, 6 as well as the re-injection path 21, whereby the pump is arranged to pump the water from the space 7 to the path 21. For this purpose the pump is provided with water inlets 33 arranged at a part of its outer periphery that borders to the space or channel 7. The pump is driven by means of a power fluid, preferably water, that is delivered to it via a pipe 28 arranged in the space 7. Upstream the pump there is arranged a plug 30 or the like to prevent oil-water mixture in the first flow path 4 from directly flowing back into the reservoir via the pump. Alternatively the pump 29 itself forms such a plug.

The pump 29 is arranged in the extension of the first tube 3 and has a cross-section equal to or smaller than the cross section of the channel defined by the first tube 3. Thereby it will be possible to easily change the pump 29, for example for maintenance reasons, as it can be transported to a topside installation inside the first tube 3 all the way.

In all the embodiments of the inventive system shown, at least along the section along which the draining openings 5 are located, the cross section of the first flow path 4 is locally expanded such that, under the prevailing pressure conditions in the well, a locally reduced flow rate of the oil-water mixture is obtained along said section. A low flow rate in this section of the first flow path 4 promotes an effective gravitational separation in the separator device 1. The required length of the draining section may also be reduced due to the local reduction of flow rate accomplished.

In FIG. 1 there is also indicated an interface measuring member 10 by means of which the water/oil ratio is measured in the first and/or second flow path. A control system (not shown) for controlling the separator operation preferably controls pre-determined separator variables, such as pump effect, water-oil mixture flow rate or width of the draining openings, based on information about said ratio received from the member 10. In order to be able to control the width or area of individual draining openings the inventive system preferably comprises any kind of opening width adjustment means, for example some sort motor-operated slide or the like for an adjustable covering of the openings. It should be understood that the above features as to the control of the system is applicable to any of the embodiments shown although only explicitly shown for the first embodiment.

It should be understood that a plurality of alternative embodiments will be obvious for a man skilled in the art without thereby going beyond the scope of the invention, as defined in the appended claims, supported by the description and the drawings.

For example, combinations of the embodiments described above will be obvious and are within the scope of the invention.

I claim:

1. An oil well system for extracting oil extracted from a reservoir via a well, comprising a separator device adapted to separate oil and water from a mixture extracted from a reservoir, said separator device comprising:

an inclined non-vertical first flow path for the mixture and being arranged along a non-vertical portion of the well;

a second flow path, separate from the first flow path, for receiving water or a water enriched phase that has been separated from the mixture by the separator device; and a plurality of drain openings along a section of the first flow path, the first and second flow paths being arranged such that water or the water enriched phase in the first flow path can flow by gravity to the second flow path via the drain openings, wherein an opening area of said drain openings, per unit area of the first flow path, decreases in a flow direction of the mixture along said section of the first flow path.

2. The oil well system according to claim 1, wherein said first flow path comprises a first tube.

3. The oil well system according to claim 2, wherein a diameter of said first tube is locally expanded along the section of the first flow path having said plurality of drain openings.

4. The oil well system according to claim 2, further comprising a second tube enclosing said first tube to form an annular path therebetween, wherein said annular path comprises said second flow path.

5. The oil well system according to claim 2, wherein said first tube has a generally circular cross section, and wherein said plurality of drain openings are located at a lower part of the cross section of the tube.

6. The oil well system according to claim 1, wherein said plurality of drain openings comprise a plurality of slots in said tube.

7. The oil well system according to claim 1, wherein said plurality of drain openings are arranged along the flow direction of the mixture along the section of the first flow path, and are positioned at different vertical levels.

8. The oil well system according to claim 1, wherein said plurality of drain openings are distributed along a length equal to at least 100 times a diameter of said first flow path.

9. The oil well system according to claim 1, further comprising a third flow path communicating said second flow path with the reservoir for reinjecting the separated water or water enriched phase into the reservoir.

10. The oil well system according to claim 1, further comprising a third flow path communicating with said second flow path for discharging the separated water or water enriched phase.

11. The oil well system according to claim 1, further comprising a third flow path communicating said second flow path with the reservoir for reinjecting the separated water or water enriched phase into the reservoir via said well.

12. The oil well system according to claim 11, further comprising a pump arranged to pump the separated water or water enriched phase from the third flow path into the reservoir.

13. The oil well system according to claim 1, further comprising a third flow path communicating said second flow path with the reservoir for reinjecting the separated water or water enriched phase into the reservoir at a position spaced from said well.

14. The oil well system according to claim 1, wherein said separator device is a down-hole separator of an off-shore well, the down-hole separator being located adjacent the reservoir.

15. A method of extracting oil from an oil reservoir, comprising:

extracting a liquid mixture comprising oil and water from a reservoir via a first flow path of a well;

separating, by gravity and via a plurality of drain openings, the liquid mixture in an inclined non-vertical section of the well into two separate streams, one of the streams comprising water or a water enriched phase, wherein an opening area of said drain openings, per unit area of the first flow path, decreases in a flow direction of the mixture along said section of the first flow path; and passing the separated stream comprising water or a water enriched phase to a separate second flow path.

16. The method of claim 15 including the step of reinjecting the separated water or water enriched phase into the reservoir.

17. The method of claim 15 including the step of reinjecting the separated water or water enriched phase into the reservoir via said well.

18. The method of claim 15 including the step of reinjecting the separated water or water enriched phase into the reservoir at a location spaced from said well.

19. The method of claim 15 including the step of reinjecting the separated water or a water enriched phase into the reservoir using a pump.

20. The method of claim 15, wherein said passing step comprises permitting the separated stream to flow through drain openings arranged at different altitudes along the first flow path.

21. The method of claim 20, wherein a flow rate of the liquid mixture is locally reduced in the first flow path in the region of the drain openings.

22. The method of claim 15, wherein the liquid mixture is extracted off-shore and wherein the separating step is performed adjacent the reservoir.

* * * * *